US011657764B2

(12) United States Patent
Chun et al.

(10) Patent No.: US 11,657,764 B2
(45) Date of Patent: May 23, 2023

(54) DISPLAY DEVICE AND METHOD OF DRIVING THE SAME

(71) Applicant: Samsung Display Co., LTD., Yongin-si (KR)

(72) Inventors: Byung Ki Chun, Yongin-si (KR); Hyeon Min Kim, Yongin-si (KR); Young Wook Yoo, Yongin-si (KR); Jun Gyu Lee, Yongin-si (KR); Hyun Jun Lim, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/502,841

(22) Filed: Oct. 15, 2021

(65) Prior Publication Data

US 2022/0122544 A1 Apr. 21, 2022

(30) Foreign Application Priority Data

Oct. 16, 2020 (KR) ..... 10-2020-0134591

(51) Int. Cl.
*G09G 3/3266* (2016.01)
*G09G 5/00* (2006.01)

(52) U.S. Cl.
CPC ..... *G09G 3/3266* (2013.01); *G09G 5/003* (2013.01); *G09G 2320/0271* (2013.01); *G09G 2360/16* (2013.01)

(58) Field of Classification Search
CPC ..... G09G 2320/0257; G09G 2320/046; G09G 2360/16; G09G 3/3233
See application file for complete search history.

(56) References Cited

U.S. PATENT DOCUMENTS 8,232,938 B2 7/2012 Kohno
9,418,591 B2 8/2016 Kim et al.
2013/0278489 A1 10/2013 Tachibana
2014/0146071 A1* 5/2014 Kim ..... G09G 3/3225 345/589

(Continued)

FOREIGN PATENT DOCUMENTS

JP 5248750 7/2013
KR 10-2016-0071886 6/2016

(Continued)

*Primary Examiner* — Van N Chow
(74) *Attorney, Agent, or Firm* — Kile Park Reed & Houtteman PLLC

(57) ABSTRACT

A display device includes pixels, an image converter generating second image data using first image data of an N-th frame and first image data of an (N+1)th frame; and a data driver supplying a data signal corresponding to the second image data to the pixels during an (N+1)th frame period. The image converter detects a logo and a logo area using the first image data, calculates a first representative value of data corresponding to a peripheral area of the logo area among the first image data of an N-th frame and a second representative value of data corresponding to a reference area among the first image data of the (N+1)th frame, and selectively converts data for the logo among the first image data of the (N+1)th frame according to the first representative value and the second representative value to generate the second image data of the (N+1)th frame.

16 Claims, 10 Drawing Sheets

(56) References Cited

U.S. PATENT DOCUMENTS

| | | | | |
|---|---|---|---|---|
| 2015/0215592 | A1* | 7/2015 | Tone | H04N 9/3155 348/744 |
| 2017/0357884 | A1* | 12/2017 | Friedman | G06K 19/06075 |
| 2020/0074708 | A1 | 3/2020 | Park | |
| 2021/0103765 | A1 | 4/2021 | Chun et al. | |
| 2021/0375189 | A1* | 12/2021 | Chun | G09G 3/2092 |
| 2022/0122544 | A1* | 4/2022 | Chun | G09G 5/003 |
| 2022/0198997 | A1* | 6/2022 | Kim | G06V 20/635 |

FOREIGN PATENT DOCUMENTS

| | | |
|---|---|---|
| KR | 10-2017-0037783 | 4/2017 |
| KR | 10-1947125 | 2/2019 |
| KR | 10-2021-0041687 | 4/2021 |

* cited by examiner

FIG. 8

PX2 PX1 LMR

| | | | | | | | | | | |
|---|---|---|---|---|---|---|---|---|---|---|
| 0 | 0 | 0 | 0 | 0 | 0 | 0 | 0 | 0 | 0 | 0 |
| 0 | 0 | 1 | 1 | 1 | 0 | 1 | 1 | 1 | 0 | 0 |
| 0 | 1 | 0 | 0 | 0 | 0 | 1 | 0 | 1 | 1 | 0 |
| 0 | 1 | 0 | 0 | 0 | 0 | 1 | 0 | 0 | 1 | 0 |
| 0 | 0 | 1 | 1 | 0 | 0 | 1 | 0 | 0 | 1 | 0 |
| 0 | 0 | 0 | 0 | 1 | 0 | 1 | 0 | 0 | 1 | 0 |
| 0 | 0 | 0 | 0 | 1 | 0 | 1 | 0 | 1 | 1 | 0 |
| 0 | 1 | 1 | 1 | 0 | 0 | 1 | 1 | 1 | 0 | 0 |
| 0 | 0 | 0 | 0 | 0 | 0 | 0 | 0 | 0 | 0 | 0 |

DISPLAY DEVICE AND METHOD OF DRIVING THE SAME

CROSS-REFERENCE TO RELATED APPLICATION(S)

This application claims priority to and benefits of Korean Patent Application No. 10-2020-0134591 under 35 U.S.C. § 119, filed on Oct. 16, 2020 in the Korean Intellectual Property Office, the entire contents of which are incorporated herein by reference.

BACKGROUND

1. Technical Field

Embodiments relate to a display device and a method of driving the same.

2. Description of the Related Art

In recent years, interest in information displays has increased. Accordingly, research and development on display devices has been continuously conducted.

It is to be understood that this background of the technology section is, in part, intended to provide useful background for understanding the technology. However, this background of the technology section may also include ideas, concepts, or recognitions that were not part of what was known or appreciated by those skilled in the pertinent art prior to a corresponding effective filing date of the subject matter disclosed herein.

SUMMARY

An object of the disclosure is to provide a display device capable of adjusting luminance of a logo according to luminance of a surrounding image and a method of driving the same.

Objects of the disclosure are not limited to the above-described object, and other objects not mentioned will be clearly understood by those skilled in the art from the following description.

A display device according to an embodiment may include pixels disposed in a display area; an image converter that generates second image data of an (N+1)th frame by using first image data of an N-th frame and first image data of the N(+1)th frame; and a data driver that supplies a data signal corresponding to the second image data of the N(+1)th frame to the pixels during an N(+1)th frame period. The image converter may detect a logo and a logo area including the logo by using the first image data of the N-th frame, the image converter may calculate a first representative value of data corresponding to a peripheral area of the logo area among the first image data of the N-th frame and a second representative value of data corresponding to a reference area among the first image data of the N(+1)th frame, and the image converter may selectively convert data for the logo among the first image data of the N(+1)th frame according to the first representative value and the second representative value to generate the second image data of the N(+1)th frame.

In an embodiment, the peripheral area of the logo area may be set as an area surrounding the logo area on four sides of the logo area.

In an embodiment, the reference area may be set as at least one area of an area of the peripheral area of the logo area that is scanned before the logo area.

In an embodiment, the display device may further include a scan driver that sequentially supplies scan signals from pixels disposed in a first row of the display area to pixels disposed in a last row of the display area during each frame period, and the reference area may be set as an area located on a top of the logo area.

In an embodiment, the display device may further include a scan driver that sequentially supplies scan signals from pixels disposed in a last row of the display area to pixels disposed in a first row of the display area during each frame period, and the reference area may be set as an area located at a bottom of the logo area.

In an embodiment, the image converter may include a logo detector that detects the logo and the logo area by using the first image data of the N-th frame; a logo level determiner that calculates the first representative value and the second representative value based on the logo area, and compares the first representative value and the second representative value to determine a logo level for the N(+1)th frame; and a data converter that generates the second image data of the N(+1)th frame by converting a grayscale value of data corresponding to the logo among the first image data of the N(+1)th frame in response to the logo level.

In an embodiment, the logo level determiner may include a first logo level determiner that calculates the first representative value for data corresponding to the peripheral area among the first image data of the N-th frame, and determines a first logo level for the N(+1)th frame in response to the first representative value; a second logo level determiner that calculates the second representative value for data corresponding to the reference area among the first image data of the (N+1)-th frame, and determines a second logo level for the N(+1)th frame in response to the second representative value; and a third logo level determiner that compares the first logo level and the second logo level to determine a third logo level for the N(+1)th frame.

In an embodiment, the third logo level determiner may determine the first logo level as the third logo level when the first logo level is greater than the second logo level, and the third logo level determiner may determine the second logo level as the third logo level when the second logo level is greater than or equal to the first logo level.

In an embodiment, the data converter may convert the grayscale value of the data corresponding to the logo among first image data of the N(+1)th frame in response to the third logo level.

In an embodiment, the first representative value may be set as a grayscale value of a pixel corresponding to a higher level luminance among grayscale values of the pixels disposed in the peripheral area of the logo area based on the first image data of the N-th frame, and the second representative value may be set as a grayscale value of a pixel corresponding to a higher level luminance among grayscale values of the pixels disposed in the reference area based on the first image data of the N(+1)th frame.

A method of driving a display device according to an embodiment may include detecting a logo and a logo area including the logo by using first image data of an N-th frame; setting a peripheral area according to the logo area, and calculating a first representative value from data corresponding to the peripheral area among the first image data of the N-th frame; setting a reference area according to the logo area, and calculating a second representative value from data corresponding to the reference area among first image data of an N(+1)th frame; determining a logo level of the N(+1)th frame using the first representative value and the second representative value; generating second image data of the N(+1)th frame by converting the first image data of the N(+1)th frame in response to the logo level; and generating a data signal corresponding to the second image data of the N(+1)th frame and supplying the data signal to pixels.

In an embodiment, the peripheral area may be set as an area surrounding the logo area on four sides of the logo area.

In an embodiment, the reference area may be set as at least one area of an area of the peripheral area that is scanned before the logo area.

In an embodiment, the calculating of the first representative value may include setting a grayscale value of a pixel corresponding to a higher level luminance among grayscale values of the pixels disposed in the peripheral area based on the first image data of the N-th frame as the first representative value.

In an embodiment, the calculating of the second representative value may include setting a grayscale value of a pixel corresponding to a higher level luminance among grayscale values of pixels disposed in the reference area based on the first image data of the N(+1)th frame as the second representative value.

In an embodiment, the determining of the logo level of the N(+1)th frame may include setting a grayscale value obtained by applying a first offset value to the first representative value as a first logo level; setting a grayscale value obtained by applying a second offset value to the second representative value as a second logo level; and determining a third logo level by comparing the first logo level and the second logo level.

In an embodiment, the determining of the third logo level may include determining the first logo level as the third logo level when the first logo level is greater than the second logo level; and determining the second logo level as the third logo level when the second logo level is greater than or equal to the first logo level.

In an embodiment, the generating of the second image data of the N(+1)th frame may include converting a grayscale value of data corresponding to the logo among first image data of the N(+1)th frame to a grayscale value corresponding to the logo level in response to the logo level.

BRIEF DESCRIPTION OF THE DRAWINGS

The accompanying drawings, which are included to provide a further understanding of the disclosure, and are incorporated in and constitute a part of this specification, illustrate embodiments of the disclosure, and, together with the description, serve to explain principles of the disclosure in which:

FIG. 8 is a diagram illustrating map data of a logo area according to an embodiment.

DETAILED DESCRIPTION OF THE EMBODIMENTS

Figure 1:
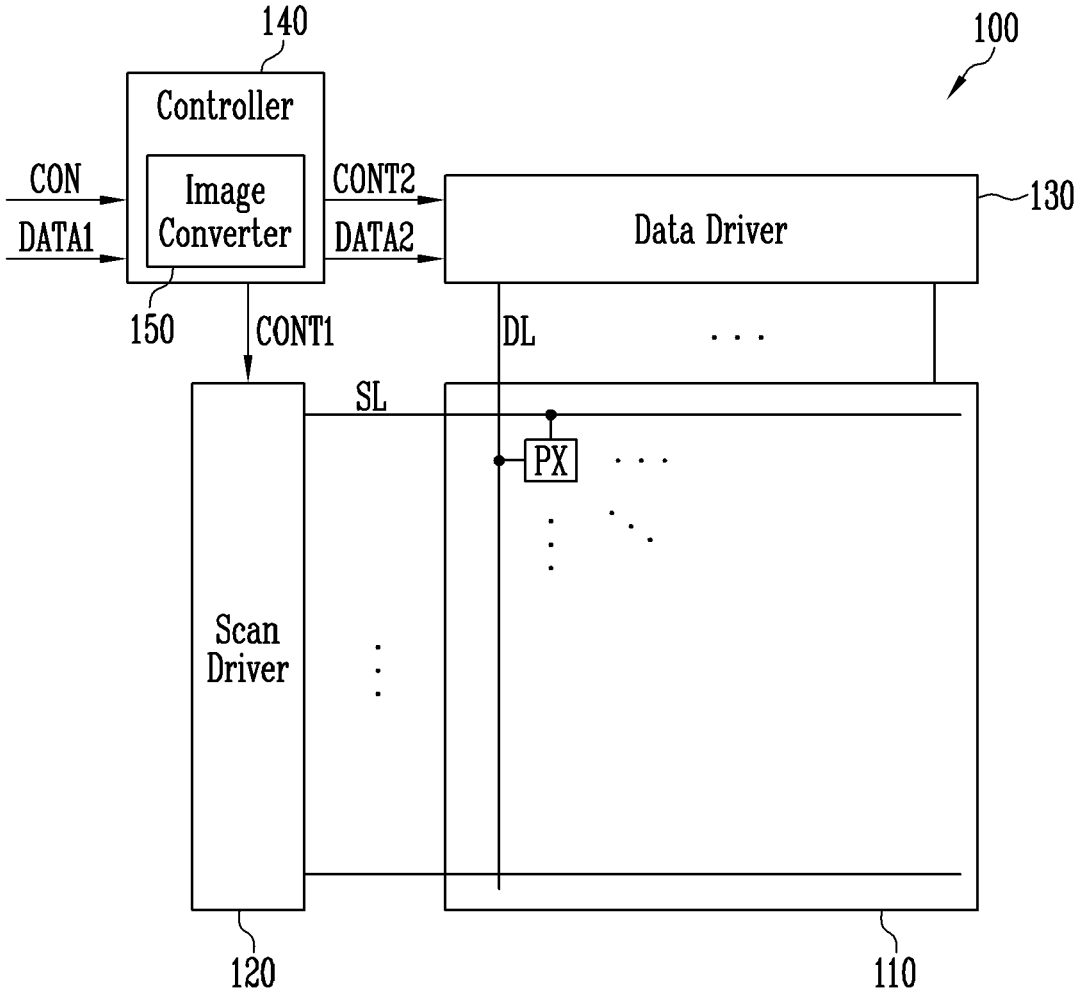
FIG. 1 is a block diagram illustrating a display device according to an embodiment.

The disclosure may be modified in various ways and may have various forms, and embodiments will be illustrated in the drawings and described in detail herein. In the following description, the singular forms also include the plural forms unless the context clearly includes only the singular.

The disclosure is not limited to the embodiments disclosed below, and may be implemented in various forms. Each of the embodiments disclosed below may be implemented alone or in combination with at least one of other embodiments.

In the drawings, some or a number of elements which may not be directly related to the features of the disclosure may be omitted for clarification. Some or a number of elements in the drawings may be shown to be exaggerated in size or proportion. Throughout the drawings, the same or similar elements will be given by the same reference numerals and symbols even though they may be shown in different drawings, and repetitive descriptions will be omitted.

In the drawings, sizes, thicknesses, ratios, and dimensions of the elements may be exaggerated for ease of description and for clarity.

In the specification and the claims, the term "and/or" is intended to include any combination of the terms "and" and "or" for the purpose of its meaning and interpretation. For example, "A and/or B" may be understood to mean "A, B, or A and B." The terms "and" and "or" may be used in the conjunctive or disjunctive sense and may be understood to be equivalent to "and/or."

In the specification and the claims, the phrase "at least one of" is intended to include the meaning of "at least one selected from the group of" for the purpose of its meaning and interpretation. For example, "at least one of A and B" may be understood to mean "A, B, or A and B."

It will be understood that, although the terms first, second, etc., may be used herein to describe various elements, these elements should not be limited by these terms. These terms are only used to distinguish one element from another element. For example, a first element may be referred to as a second element, and similarly, a second element may be referred to as a first element without departing from the scope of the disclosure.

The spatially relative terms "below", "beneath", "lower", "above", "upper", or the like, may be used herein for ease of description to describe the relations between one element or component and another element or component as illustrated in the drawings. It will be understood that the spatially relative terms are intended to encompass different orientations of the device in use or operation, in addition to the orientation depicted in the drawings. For example, in the case where a device illustrated in the drawing is turned over, the device positioned "below" or "beneath" another device may be placed "above" another device. Accordingly, the illustrative term "below" may include both the lower and upper positions. The device may also be oriented in other directions and thus the spatially relative terms may be interpreted differently depending on the orientations.

The terms "comprises," "comprising," "includes," and/or "including,", "has," "have," and/or "having," and variations thereof when used in this specification, specify the presence of stated features, integers, steps, operations, elements, components, and/or groups thereof, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

Embodiments may be described and illustrated in the accompanying drawings in terms of functional blocks, units, and/or modules.

Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies.

In the case of the blocks, units, and/or modules being implemented by microprocessors or other similar hardware, they may be programmed and controlled using software (for example, microcode) to perform various functions discussed herein and may optionally be driven by firmware and/or software.

It is also contemplated that each block, unit, and/or module may be implemented by dedicated hardware, or as a combination of dedicated hardware to perform some functions and a processor (for example, one or more programmed microprocessors and associated circuitry) to perform other functions.

Each block, unit, and/or module of embodiments may be physically separated into two or more interacting and discrete blocks, units, and/or modules without departing from the scope of the disclosure.

Further, the blocks, units, and/or modules of embodiments may be physically combined into more complex blocks, units, and/or modules without departing from the scope of the disclosure.

Unless otherwise defined, all terms (including technical and scientific terms) used herein have the same meaning as commonly understood by one of ordinary skill in the art to which the disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a display device 100 according to an embodiment.

Referring to FIG. 1, a display device 100 according to an embodiment may include a display area 110 in which pixels PX may be arranged or disposed (or a display panel including the display area), and a scan driver 120, a data driver 130, a controller 140, and an image converter 150 for driving the pixels PX.

In an embodiment, the scan driver 120, the data driver 130, the controller 140, and/or the image converter 150 may be integrated into one driver IC, but the disclosure is not limited thereto. The image converter 150 may be provided or disposed inside of the controller 140, but the disclosure is not limited thereto. For example, in an embodiment, the image converter 150 may be provided in a separate configuration from the controller 140.

The display area 110 may include scan lines SL, data lines DL, and the pixels PX electrically connected to the scan lines SL and data lines DL. In describing embodiments, the term "connection" may mean both a physical connection and an electrical connection.

The scan lines SL may electrically connect the scan driver 120 and the pixels PX. Accordingly, scan signals output from the scan driver 120 may be transmitted to the pixels PX through the scan lines SL. The timing at which each data signal is input to the pixels PX (for example, a data programming period) may be controlled by the scan signals.

The data lines DL may electrically connect the data driver 130 and the pixels PX. Accordingly, data signals output from the data driver 130 may be transmitted to the pixels PX through the data lines DL. Luminance of light emitted from each pixel PX during each frame may be controlled by the data signals.

Each pixel PX may be electrically connected to at least one scan line SL and at least one data line DL. For example, a pixel PXij arranged or disposed in an i-th pixel row (also referred to as an i-th horizontal line) and a j-th pixel column (also referred to as a j-th vertical line) in the display area 110 may be electrically connected to an i-th scan line and a j-th data line.

When a scan signal is supplied from each scan line SL, the pixels PX may receive a data signal through each data line DL. The pixels PX may be supplied with at least one driving power source (for example, a first power source as a high potential pixel power source and a second power source as a low potential pixel power source).

The pixels PX may emit light with luminance corresponding to each data signal in each emission period of each frame. However, a pixel receiving a black data signal in a given frame may be maintained in a substantially non-emission state during the emission period of the corresponding frame.

In an embodiment, each of the pixels PX may be a self-light emitting type pixel including at least one light emitting element, but the disclosure is not limited thereto. For example, the type, structure, and/or driving method of the pixels PX may be variously changed according to embodiments.

The scan driver 120 may receive a first control signal CONT1 from the controller 140 and supply the scan signals to the scan lines SL in response to the first control signal CONT1. For example, the scan driver 120 may receive the first control signal CONT1 including a scan start signal (for example, a sampling pulse input to a first scan stage) and a scan clock signal, and sequentially output the scan signals to the scan lines SL in response thereto.

In an embodiment, the scan driver 120 may include a plurality of scan stages dependently electrically connected to each other to sequentially output the scan signals along at least one direction or in a direction. The scan driver 120 may select the pixels PX of the display area 110 while sequentially supplying the scan signals to the scan lines SL along a certain or given direction during a scan period of each frame.

In an embodiment, the scan driver 120 may sequentially supply the scan signals to the scan lines SL in an order from a first scan line provided or disposed in a first pixel row to a last scan line provided or disposed in a last pixel row. The pixels PX may be scanned in a direction (for example, a forward direction) from an upper area toward a lower area of the display area 110.

In an embodiment, the scan driver 120 may sequentially supply the scan signals to the scan lines SL in an order from the last scan line provided or disposed in the last pixel row to the first scan line provided or disposed in the first pixel row. The pixels PX may be scanned in a direction (for example, a reverse direction) from the lower area toward the upper area of the display area 110.

In an embodiment, the scan driver 120 may regularly change the scan direction at a period of at least one frame, or may change the scan direction regularly or irregularly according to a predetermined or selected condition or command.

The pixels PX selected by each scan signal may receive the data signals of the corresponding frame from the data lines DL.

The data driver 130 may receive a second control signal CONT2 and second image data DATA2 from the controller 140, and generate the data signals in response to the second control signal CONT2 and the second image data DATA2. For example, the data driver 130 may receive the second image data DATA2 together with the second control signal CONT2 including a source sampling pulse, a source sampling clock, a source output enable signal, and the like, and may generate the data signals corresponding to the second image data DATA2. In an embodiment, the data signals may be generated in the form of data voltages corresponding to the luminance to be displayed by the pixels PX, but the disclosure is not limited thereto.

The data driver 130 may supply each data signal to the pixels PX through the data lines DL. For example, for each horizontal period, the data driver 130 may output corresponding data signals to the pixels PX selected in the corresponding horizontal period through the data lines DL. The data signals output through the data lines DL may be supplied to the pixels PX selected by the scan signal.

The controller 140 may receive control signals CON and first image data DATA1 from outside (for example, a host processor), and drive the scan driver 120 and the data driver 130 in response to the control signals CON and the first image data DATA1.

For example, the controller 140 may receive the control signals CON including a vertical synchronization signal, a horizontal synchronization signal, a main clock signal, and the like, and may generate the first and second control signals CONT1 and CONT2 in response thereto. The first control signal CONT1 may be supplied to the scan driver 120, and the second control signal CONT2 may be supplied to the data driver 130.

Also, the controller 140 may convert and/or rearrange the first image data DATA1 corresponding to an image to be displayed in each frame to generate the second image data DATA2, and supply the second image data DATA2 to the data driver 130. Accordingly, a data signal corresponding to the second image data DATA2 may be supplied to the pixels PX, and a second image corresponding to the second image data DATA2 may be displayed in the display area 110.

In an embodiment, the controller 140 may include an image converter 150 for adjusting luminance of a logo area, for example, luminance of a logo.

The image converter 150 may detect the logo area using the first image data DATA1 of each frame (or the first image data DATA1 for a plurality of frames), and generate the second image data DATA2 by selectively adjusting the luminance of the logo according to luminance of a surrounding image.

For example, when the luminance of the surrounding image is relatively low, visibility can be secured even if the luminance of the logo is lowered. The image converter 150 may generate the second image data DATA2 by converting the first image data DATA1 such that the luminance of the logo may be lowered by reducing a grayscale value of data corresponding to the logo among the first image data DATA1.

When the luminance of the surrounding image is high, the image converter 150 may generate the second image data DATA2 by converting the first image data DATA1 so that the luminance of the logo may be maintained or the amount of change in luminance may be reduced by maintaining the grayscale value of the data corresponding to the logo among the first image data DATA1 or reducing the grayscale value to a relatively low level.

The second image data DATA2 may be supplied to the data driver 130 and used to generate the data signal. Accordingly, an image corresponding to the second image data DATA2 may be displayed in the display area 110.

The surrounding image may be an image displayed in a peripheral area of a predetermined or selected range located or disposed around the logo area during each frame. The peripheral area may be an area of a predetermined or selected range adjacent to the logo area, and may be an area surrounding the logo area. As an example, the peripheral area may be an area surrounding the logo area on four sides, and may be an area including a predetermined or selected number of pixels (or horizontal or vertical lines) based on the left or right and top or bottom of the logo area.

For example, the image converter 150 may selectively adjust the luminance of the logo according to the luminance of the surrounding image. Also, the image converter 150 may adaptively and/or differentially change the luminance of the logo according to the luminance of the surrounding image. For example, the image converter 150 may detect the luminance of the surrounding image by analyzing a grayscale value of data corresponding to the peripheral area (as data corresponding to the pixels PX positioned or disposed in the peripheral area, also referred to as peripheral area data) from the first image data DATA1 of each frame, and generate the second image data DATA2 of a next frame by setting a grayscale value corresponding to luminance of a predetermined higher level (for example, a grayscale value corresponding to the upper 3% or the upper 30%, or approximations thereof, or a grayscale value obtained by applying a predetermined or selected offset value to the grayscale value) among grayscale values of data of the peripheral area as a grayscale value of the logo in the next frame.

For example, the image converter 150 may selectively reduce the luminance of the logo (or logo area) according to the luminance of the surrounding image, and adaptively and/or differentially set the luminance of the logo in response to the luminance of the surrounding image. For example, the higher the luminance of the surrounding image, the higher the luminance of the logo may be. When the luminance of the surrounding image is greater than or equal to a predetermined or selected reference level, the luminance of the logo may be maintained at luminance corresponding to the highest grayscale value (for example, a white grayscale value). On the other hand, the lower the luminance of the surrounding image, the lower the luminance of the logo may be. However, the lower limit luminance of the logo may be set so that the luminance of the logo does not fall below a predetermined or selected level.

In this way, by adjusting the luminance of the logo according to the luminance of the surrounding image, visibility of the logo may be ensured, and deterioration of the pixels PX positioned or disposed in the logo area and afterimages caused by this may be prevented or reduced.

At least one area among the peripheral area may be an area scanned after the logo area. Accordingly, when the luminance of the logo area is adjusted by analyzing the luminance of the entire peripheral area, a delay of at least one frame may occur. For example, analysis result of the data of the peripheral area among the first image data DATA1 of an N-th frame (also referred to as a previous frame or an immediately preceding frame) may be applied to convert data of the logo among the first image data DATA1 of an N(+1)th frame (also referred to as a current frame).

When the luminance of the surrounding image changes rapidly, a phenomenon in which the luminance of the surrounding image and the luminance of the logo are reversed may occur. Accordingly, the visibility of the logo may be deteriorated.

For example, in the case where the luminance of the peripheral area rapidly increases in the image displayed in the N(+1)th frame compared to the image displayed in the N-th frame, when the grayscale value of the logo in the N(+1)th frame is set based on the first image data DATA1 for the peripheral area of the N-th frame, the luminance of the logo in the N(+1)th frame may not be set sufficiently higher than the luminance of the surrounding image or may be lower than the luminance of the surrounding image. Accordingly, the visibility of the logo may be deteriorated in the N(+1)th frame.

In order to improve the visibility of the logo, the image converter 150 according to an embodiment may set a predetermined area located or disposed around the logo area and scanned before the logo area during each frame period as a reference area, and control the luminance of the logo in the N(+1)th frame according to the luminance of the surrounding image displayed in the peripheral area in the N-th frame and luminance of a reference image displayed in the reference area in the N(+1)th frame. According to an embodiment described above, the luminance of the logo may be adjusted in real time according to the luminance of the surrounding image. Accordingly, the phenomenon in which the luminance of the surrounding image and the luminance of the logo are reversed may be prevented, and the visibility of the logo may be improved.

Figure 2:
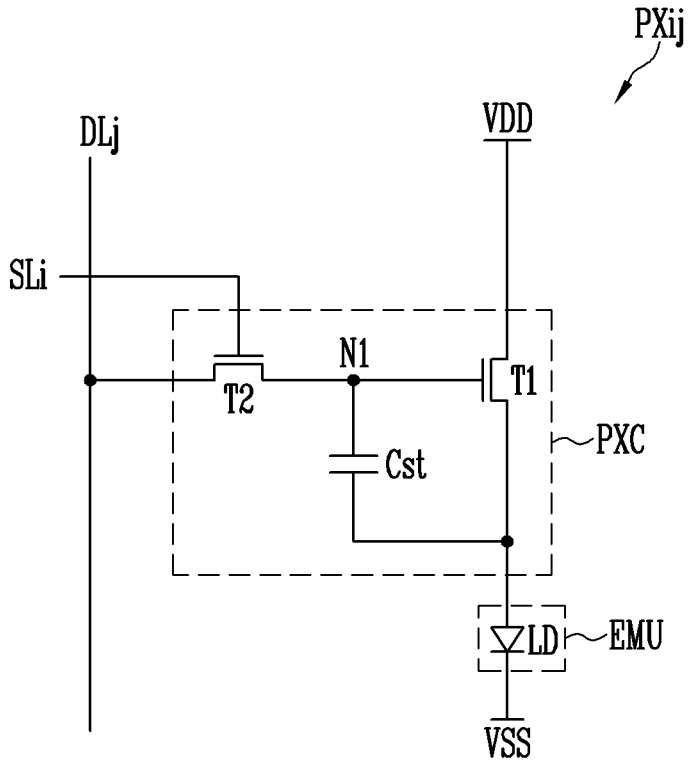
FIG. 2 is an equivalent circuit diagram illustrating a pixel according to an embodiment.
Figure 3:
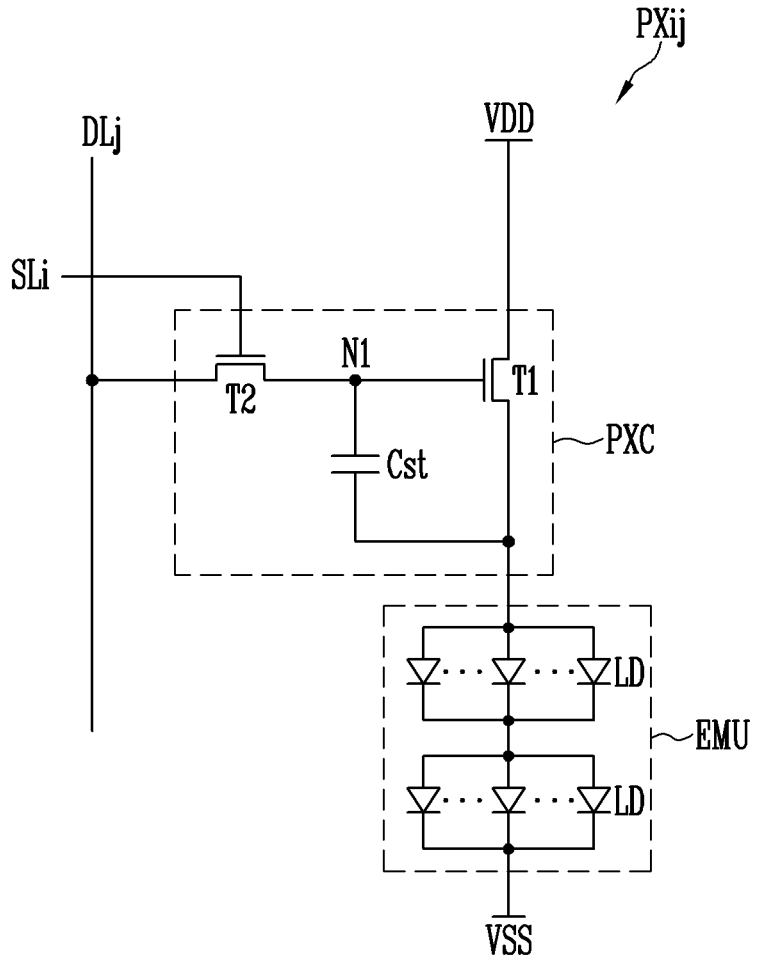
FIG. 3 is an equivalent circuit diagram illustrating a pixel according to an embodiment.

FIGS. 2 and 3 illustrate a pixel PXij according to an embodiment. For example, FIGS. 2 and 3 illustrate embodiments of an arbitrary pixel PXij electrically connected to an i-th scan line SLi and a j-th data line DLj among the pixels PX arranged or disposed in the display area 110 of FIG. 1. The pixels PX disposed in the display area 110 may have substantially similar or identical structures to each other.

According to an embodiment, FIGS. 2 and 3 illustrate an example of a self-light emitting type pixel PXij that may be provided or disposed in a self-light emitting type display device. However, the disclosure is not limited thereto. FIGS. 2 and 3 illustrate different embodiments in relation to a light emitting unit EMU.

Referring to FIGS. 1, 2 and 3, the pixel PXij may include a light emitting unit EMU including at least one light emitting element LD electrically connected between a first power source VDD and the second power source VSS. The pixel PXij may selectively further include a pixel circuit PXC for controlling and/or driving the light emitting unit EMU.

The pixel circuit PXC may be electrically connected between the first power source VDD and the light emitting unit EMU. Further, the pixel circuit PXC may be electrically connected to the scan line SLi and the data line DLj of the corresponding pixel PXij, and control an operation of the light emitting unit EMU in response to a scan signal and a data signal supplied from the scan line SLi and the data line DLj during each frame period. The pixel circuit PXC may have various structures in addition to the structures shown in FIGS. 2 and 3, and may be selectively further electrically connected to at least one control line and/or a third power source. For example, the pixel circuit PXC may be further electrically connected to an initialization control line, a sensing signal line, a sensing line, and/or an initialization power source.

The pixel circuit PXC may include at least one transistor and a capacitor. For example, the pixel circuit PXC may include a first transistor T1, a second transistor T2, and a storage capacitor Cst.

The first transistor T1 may be electrically connected between the first power source VDD and a first electrode of the light emitting unit EMU (for example, an anode electrode of at least one light emitting element LD). A gate electrode of the first transistor T1 may be electrically connected to a first node N1. The first transistor T1 may control a driving current supplied to the light emitting unit EMU in response to a voltage of the first node N1. For example, the first transistor T1 may be a driving transistor that controls the driving current of the pixel PXij.

The second transistor T2 may be electrically connected between the data line DLj and the first node N1. A gate electrode of the second transistor T2 may be electrically connected to the scan line SLi. The second transistor T2 may be turned on when a scan signal of a gate-on voltage (for example, a high level voltage) is supplied from the scan line SLi to electrically connect the data line DLj and the first node N1.

In each frame period, a data signal of a corresponding frame may be supplied to the data line DLj, and the data signal may be transmitted to the first node N1 through the first transistor T2 turned on during a period when the scan signal of the gate-on voltage is supplied. For example, the second transistor T2 may be a switching transistor for transmitting each data signal to the inside of the pixel PXij.

Each frame period may correspond to a period in which an image of each frame is displayed. Each frame period may include a scan period (data input period) and the like for displaying the image of each frame.

One or an electrode of the storage capacitor Cst may be electrically connected to the first node N1, and the other or another electrode may be electrically connected to a second electrode of the first transistor T1. The storage capacitor Cst may charge a voltage corresponding to the data signal supplied to the first node N1 during each frame period.

In FIGS. 2 and 3, all transistors included in the pixel circuit PXC, for example, the first and second transistors T1 and T2 are shown as N-type transistors, but the disclosure is not limited thereto. For example, at least one of the first and second transistors T1 and T2 may be changed to a P-type transistor. As an example, the pixel circuit PXC according to an embodiment may include only P-type transistors or may include a combination of P-type and N-type transistors.

The structure and driving method of the pixel PXij may be variously changed. For example, the pixel circuit PXC may include pixel circuits having various structures and/or driving methods in addition to embodiments shown in FIGS. 2 and 3.

As an example, the pixel circuit PXC may further include at least one circuit element such as a sensing transistor for sensing characteristic information of the pixel PXij including a threshold voltage of the first transistor T1, a compensation transistor for electrically connecting the first transistor T1 in a diode shape during a predetermined compensation period to compensate for the threshold voltage of the first transistor T1 and the like, an initialization transistor for initializing the voltage of the first node N1 and/or the first electrode of the light emitting unit EMU, an emission control transistor for controlling an emission period of the light emitting unit EMU, and a boosting capacitor for boosting the voltage of the first node N1.

In an embodiment, when the pixel PXij is a pixel of a passive type light emitting display device, the pixel circuit PXC may be omitted. The light emitting unit EMU may be electrically connected or directly electrically connected to the scan line SLi, the data line DLj, a first power source line supplied with the first power source VDD, a second power source line supplied with the second power source VSS, and/or other signal lines or power source lines.

The light emitting unit EMU may include at least one light emitting element LD electrically connected in a forward direction between the first power source VDD and the second power source VSS. For example, the light emitting unit EMU may include a single light emitting element LD electrically connected in the forward direction between the pixel circuit PXC and the second power source VSS as shown in the embodiment of FIG. 2. One or an electrode (for example, an anode electrode) of the light emitting element LD may be electrically connected to the first power source VDD through the pixel circuit PXC, and the other or another electrode (for example, a cathode electrode) of the light emitting element LD may be electrically connected to the second power source VSS.

The first power source VDD and the second power source VSS may have different potentials so that the light emitting element LD emits light. As an example, the first power source VDD may be set as a high potential pixel power source, and the second power source VSS may be set as a low potential pixel power source having a potential lower than a threshold voltage of the light emitting element LD compared to the potential of the first power source VDD.

When the driving current is supplied from the pixel circuit PXC, the light emitting element LD may generate light with luminance corresponding to the driving current. Accordingly, each pixel PXij may emit light with luminance corresponding to the data signal supplied to the first node N1 during each frame period. When the data signal corresponding to a black grayscale is supplied to the first node N1 during a corresponding frame period, the pixel circuit PXC may not supply the driving current to the light emitting element LD, and accordingly, the pixel PXij may be maintained in a non-emission state during the corresponding frame period.

Referring to FIG. 3, the light emitting unit EMU may include a plurality of light emitting elements LD electrically connected in the forward direction between the first power source VDD and the second power source VSS. For example, the light emitting unit EMU may include a plurality of light emitting elements LD electrically connected in series and parallel to each other between the pixel circuit PXC and the second power source VSS.

The connection structure of the light emitting elements LD may be variously changed according to embodiments. For example, in an embodiment, the light emitting elements LD may be electrically connected only in series or in parallel with each other.

In an embodiment, each light emitting element LD may be a light emitting diode including an organic or inorganic light emitting layer. For example, the light emitting element LD may be an organic light emitting diode, an inorganic light emitting diode, or a quantum dot or well light emitting diode, but the disclosure is not limited thereto.

For example, in the disclosure, the type, structure, shape, size, number, and/or connection structure of the light emitting element LD is not particularly limited, and may be variously changed according to embodiments.

Figure 4:
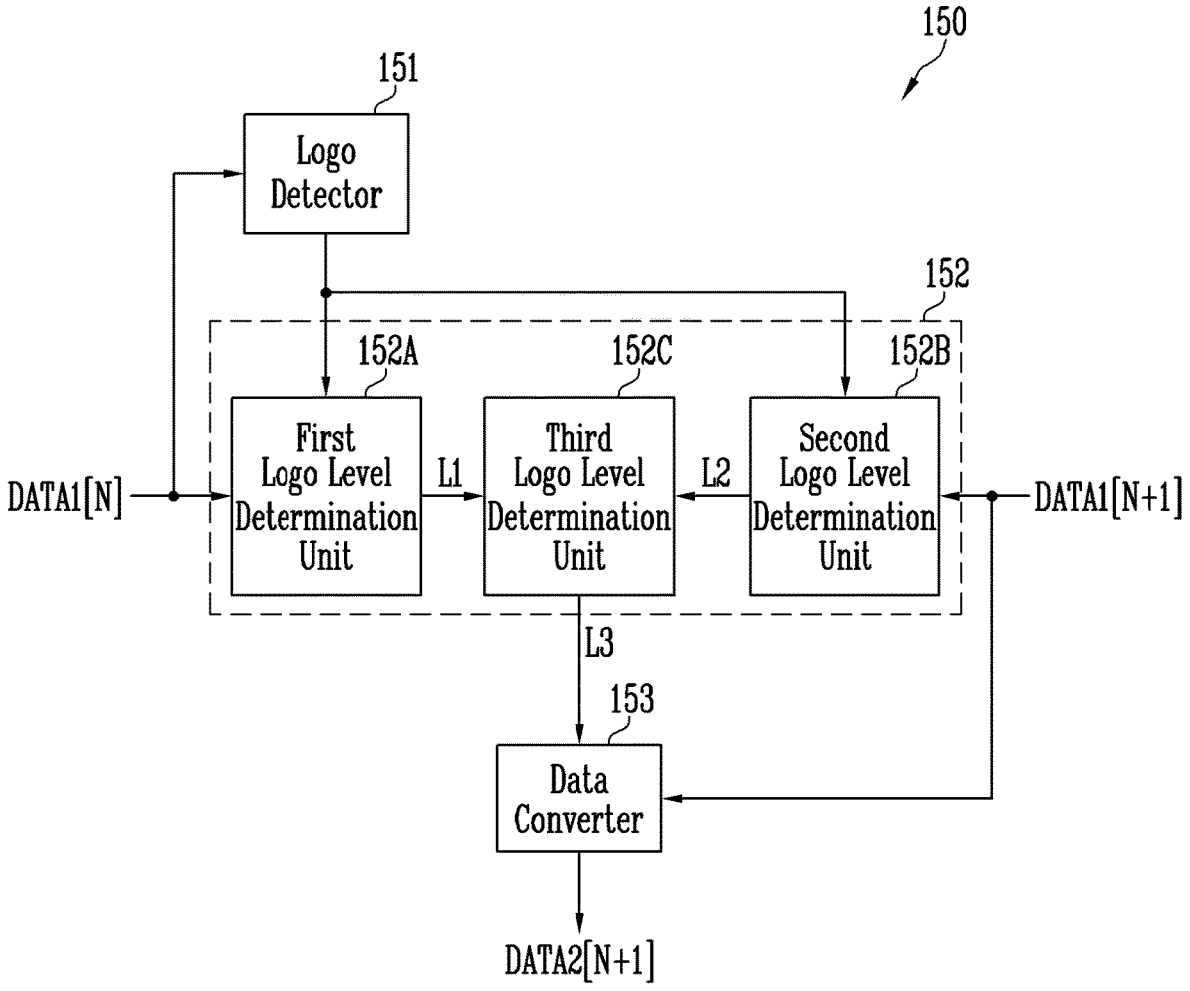
FIG. 4 is a block diagram illustrating an image converter according to an embodiment.
Figure 5:
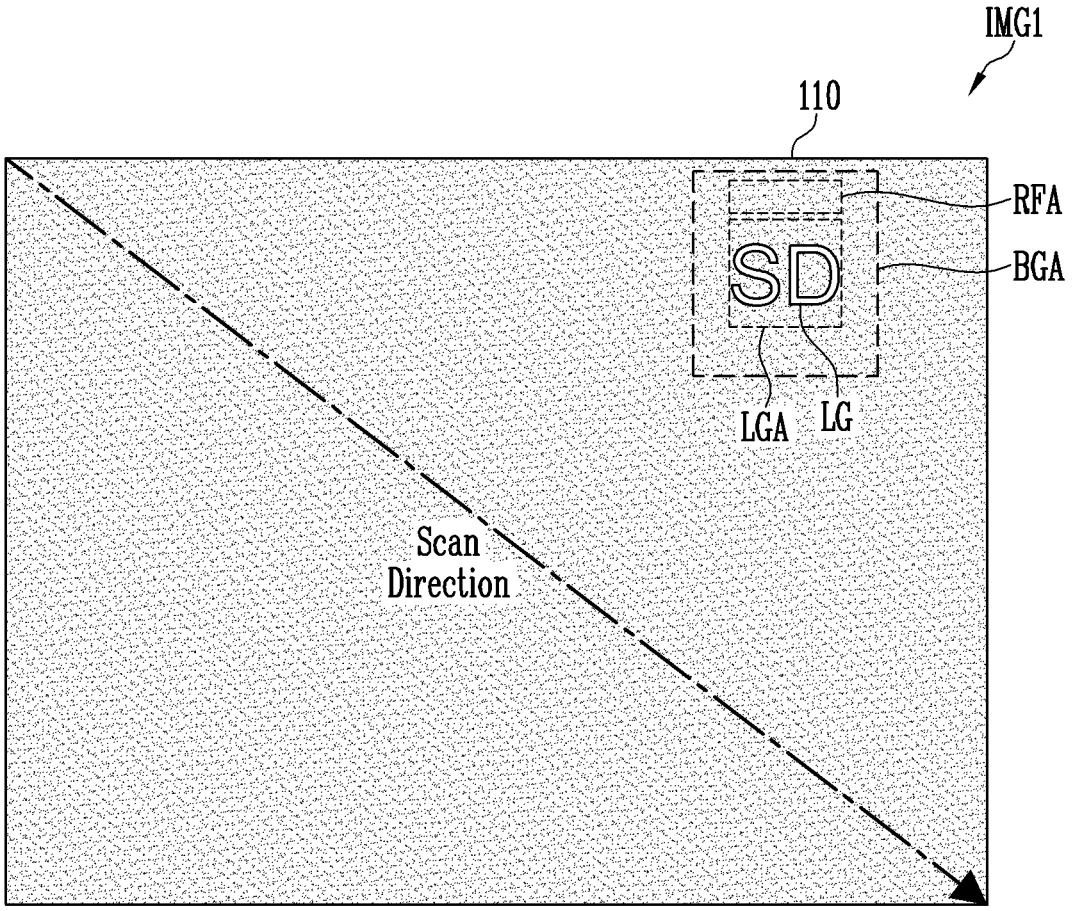
FIG. 5 is a diagram illustrating a first image, a logo area, a peripheral area, and a reference area according to an embodiment.
Figure 6:
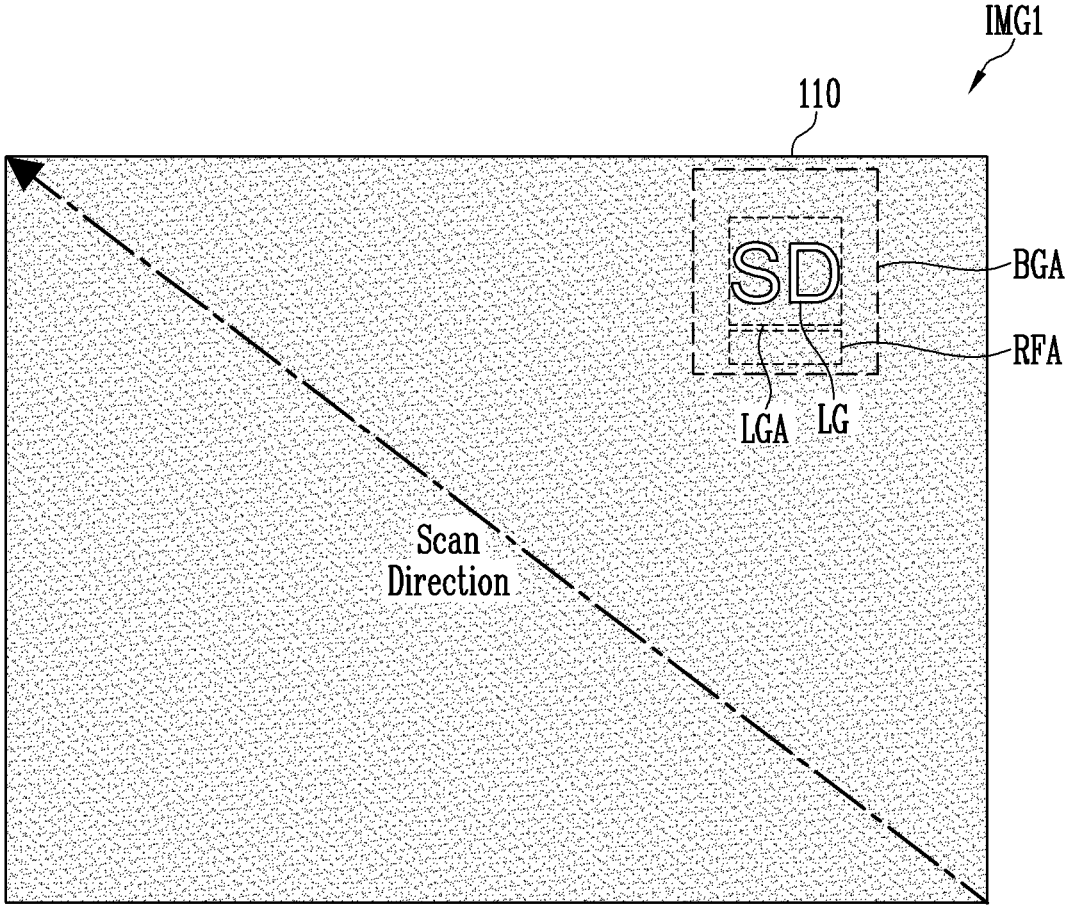
FIG. 6 is a diagram illustrating a first image, a logo area, a peripheral area, and a reference area according to an embodiment.
Figure 7:
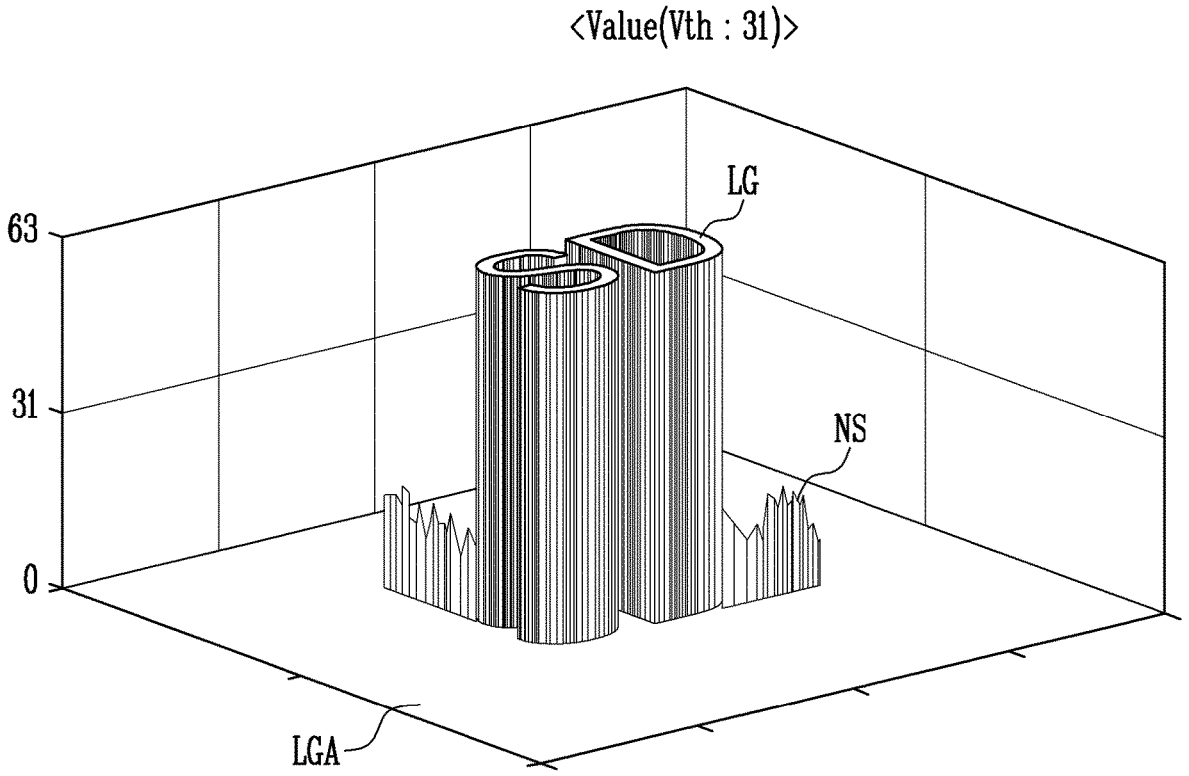
FIG. 7 is a diagram illustrating a distribution of grayscale values for a first image of a logo area according to an embodiment.

FIG. 4 is a block diagram illustrating an image converter 150 according to an embodiment. FIGS. 5 and 6 are diagrams illustrating a first image IMG1, a logo area LGA, a peripheral area BGA, and a reference area RFA according to an embodiment. FIG. 7 is a diagram illustrating a distribution of grayscale values for a first image IMG1 of a logo area LGA according to an embodiment. FIG. 8 is a diagram illustrating map data LMR of a logo area LGA according to an embodiment.

According to an embodiment, the first image IMG1 may be an image corresponding to the first image data DATA1 of each frame. When the first image IMG1 includes the logo LG, the logo area LGA may be an area of a predetermined or selected range including the logo LG. Also, the peripheral area BGA and the reference area RFA may be predetermined or selected areas set based on the logo area LGA. For convenience, in embodiments of FIGS. 5 and 6, the logo area LGA, the peripheral area BGA, and the reference area RFA are shown as substantially rectangular areas. However, the shape and size of the logo area LGA, the peripheral area BGA, and/or the reference area RFA may vary according to embodiments.

The logo LG may be an image (for example, a still image) repeatedly and/or continuously displayed in first images IMG1 corresponding to a plurality of consecutive frames. For example, among first image data DATA1 corresponding to a plurality of consecutive first images IMG1, data corresponding to the logo may have a constant position and grayscale value in a plurality of frames.

Referring to FIGS. 1 to 6, the image converter 150 may generate second image data DATA2[N+1] of the N(+1)th frame using first image data DATA1[N] of the N-th frame and first image data DATA1[N+1] of the N(+1)th frame. For example, the image converter 150 may detect the logo LG and the logo area LGA including the same using the first image data DATA1[N] of the N-th frame (and/or the first image data DATA1 of previous frames), and calculate a representative value (hereinafter, referred to as a first representative value) of data corresponding the peripheral area BGA (for example, the peripheral area data) among the first image data DATA1[N] of the N-th frame and a representative value (hereinafter, referred to as a second representative value) of data corresponding to the reference area RFA (as data corresponding to the pixels PX positioned or disposed in the reference area RFA, also referred to as reference area data) among the first image data DATA1[N+1] of the N(+1) th frame. Also, the image converter 150 may generate second image data DATA2[N+1] of the N(+1)th frame by selectively converting the data for the logo LG (as data corresponding to the pixels PX displaying the logo LG, also referred to as logo data) among the first image data DATA1

[N+1] of the N(+1)th frame according to the first representative value and the second representative value.

The peripheral area BGA may be an area set according to the logo area LGA, and may be a background area of a predetermined or selected range located or disposed immediately around the logo area LGA. For example, as in embodiments of FIGS. 5 and 6, the peripheral area BGA may be set as an area surrounding the logo area LGA on four sides. In an embodiment, the peripheral area BGA may have a shape substantially corresponding to the shape of the logo area LGA, but the disclosure is not limited thereto.

The reference area RFA may be an area set according to the logo area LGA and a scan direction (or scan order), and may be an area that is scanned before the logo area LGA among the area located or disposed immediately around the logo area LGA. For example, the reference area RFA may be set as at least one area of the area that is scanned before the logo area LGA during the corresponding frame period among the peripheral area BGA.

For example, as in the embodiment of FIG. 5, when the pixels PX are sequentially scanned in a direction from the first row to the last row of the display area 110, the reference area RFA may be set as an area of a predetermined range disposed on the top of the logo area LGA. In an embodiment, the reference area RFA may be set inside of the peripheral area BGA, but the disclosure is not limited thereto.

When the pixels PX are scanned in the forward direction as in an embodiment of FIG. 5, the scan driver 120 of FIG. 1 may sequentially supply the scan signals to the scan lines SL in an order from the scan line SL arranged or disposed in the first row of the display area 110 to the scan line SL arranged or disposed in the last row of the display area 110 during each frame period (for example, the scan period of each frame). Accordingly, the scan signals may be sequentially supplied from the pixels PX arranged or disposed in the first row of the display area 110 to the pixels PX arranged or disposed in the last row of the display area 110 during each frame period.

When the pixels PX are sequentially scanned in the reverse direction from the last row to the first row of the display area 110 as in the embodiment of FIG. 6, the reference area RFA may be set as an area of a predetermined or selected range disposed at the bottom of the logo area LGA. In an embodiment, the reference area RFA may be set inside of the peripheral area BGA, but the disclosure is not limited thereto.

When the pixels PX are scanned in the reverse direction as in an embodiment of FIG. 6, the scan driver 120 of FIG. 1 may sequentially supply the scan signals to the scan lines SL in an order from the scan line SL arranged or disposed in the last row of the display area 110 to the scan line SL arranged or disposed in the first row of the display area 110 during each frame period (for example, the scan period of each frame). Accordingly, the scan signals may be sequentially supplied from the pixels PX arranged or disposed in the last row of the display area 110 to the pixels PX arranged or disposed in the first row of the display area 110 during each frame period.

For example, the reference area RFA may be determined according to the position of the logo area LGA and the scan direction (or scan order). For example, the reference area RFA may be set as an area having a predetermined or selected range and/or size scanned before the logo area LGA while affecting the visibility of the logo LG by being located or disposed around the logo area LGA. Before displaying the logo LG corresponding to each frame, the first image data DATA1 for the reference area RFA in the corresponding frame may be supplied to the image converter 150.

Accordingly, the image converter 150 may analyze luminance of the reference area RFA based on the reference area data in the corresponding frame (for example, the N(+1)th frame), and adjust the luminance of the logo LG in the corresponding frame according to the luminance of the reference area RFA.

As an example, the image converter 150 may include a logo detector 151, a logo level determination unit or a logo level determiner 152, and a data converter 153 as shown in FIG. 4.

The logo detector 151 may receive the first image data DATA1 of each frame and detect the logo LG and the logo area LGA including the same based on the first image data DATA1. When the logo area LGA is detected, the peripheral area BGA and the reference area RFA may be defined based on the logo area LGA according to a predetermined or selected reference and/or range.

The logo detector 151 may detect the logo LG included in the first image IMG1 using various logo detection algorithms, and set the area of a predetermined range including the logo LG as the logo area LGA. For example, the logo detector 151 may detect the logo LG that continuously maintains the same position and grayscale value and the logo area LGA including the same by comparing the first image data DATA1 corresponding to the plurality of consecutive frames.

In an embodiment, the logo detector 151 may receive the first image data DATA1 of each frame, and generate map data LMR of the logo area LGA by analyzing data on logo area LGA among the first image data DATA1 of each frame (or accumulated data of the first image data DATA1 for the plurality of consecutive frames). For example, when a distribution of grayscale values of the first image IMG1 of the N-th frame (for example, a distribution of grayscale values of data corresponding to the logo area LGA (as data corresponding to the pixels PX positioned or disposed in the logo area LGA, also referred to as logo area data) among the first image data DATA1[N] of the N-th frame corresponding to the first image IMG1) is the same as that of the embodiment shown in FIG. 7, the logo detector 151 may generate the map data LMR as shown in FIG. 8 by extracting the pixels PX having a grayscale value equal to or greater than a predetermined or set reference grayscale value Vth (for example, 31 grayscales). Here, the reference grayscale value Vth may be a value set through an experiment or the like within the spirit and the scope of the disclosure. The grayscale value of 31 is an example, and the reference grayscale value Vth may be variously changed.

As an example, the logo detector 151 may generate the map data LMR indicating pixels PX1 determined as the logo LG among the pixels PX of the logo area LGA as a first binary level and indicating remaining pixels PX2 as a second binary level. In FIG. 8, the map data LMR when the first binary level is set to 1 and the second binary level is set to 0 is shown. For example, in the map data LMR, values of the pixels PX1 corresponding to the logo LG may be 1, and values of the remaining pixels PX2 may be 0.

In an embodiment, the logo detector 151 may detect the logo LG according to a logo detection algorithm through Otsu binarization. For example, the logo detector 151 may remove noise NS and detect the logo LG with higher accuracy by detecting the logo LG through multi-step Otsu binarization. However, in the disclosure, the logo detection method is not limited to the logo detection algorithm through Otsu binarization, and may be variously changed according to embodiments.

The logo level determination unit or a logo level determiner 152 may determine a logo level (for example, the luminance or grayscale value of the logo LG) for the N(+1)th frame based on information on the logo area LGA detected by the logo detector 151 (for example, the map data LMR of the logo area LGA) and the first image data DATA1[N] and DATA1[N+1] of the N-th and N(+1)th frames. For example, the logo level determination unit or a logo level determiner 152 may calculate (or detect) the first representative value for the peripheral area data among the first image data DATA1[N] of the N-th frame and the second representative value for the reference area data among the first image data DATA1[N+1] of the N(+1)th frame, and determine the logo level for the N(+1)th frame by comparing the first representative value and the second representative value.

As an example, the logo level determination unit or a logo level determiner 152 may include first, second, and third logo level determination units or first, second, and third logo level determiners 152A, 152B, and 152C. In FIG. 4, the logo level determination unit or a logo level determiner 152 may be divided into three blocks according to the function and/or operation of the logo level determination unit or a logo level determiner 152, but the disclosure is not limited thereto. For example, the first, second, and/or third logo level determination units or first, second, and/or third logo level determiners 152A, 152B, and 152C may be integrated into one block.

The first logo level determination unit or first logo level determiner 152A may calculate the first representative value for the peripheral area data among the first image data DATA1[N] of the N-th frame, and determine a first logo level L1 for the N(+1)th frame in response to the first representative value.

For example, the first logo level determination unit or first logo level determiner 152A may set a grayscale value of a pixel PX corresponding to a predetermined higher level luminance (for example, luminance corresponding to the upper 3% or the upper 30% in the peripheral area BGA or approximations thereof) among grayscale values of the pixels PX positioned or disposed in the peripheral area BGA based on the first image data DATA1[N] of the N-th frame as the first representative value.

The first logo level determination unit or first logo level determiner 152A may determine the grayscale value corresponding to the first representative value (or a luminance level corresponding thereto) as the first logo level L1. In an embodiment, the first logo level determination unit or first logo level determiner 152A may determine the first representative value as the first logo level L1. In an embodiment, the first logo level determination unit or first logo level determiner 152A may determine a grayscale value obtained by applying a predetermined or selected first offset value to the first representative value as the first logo level L1. For example, the first logo level determination unit or first logo level determiner 152A may set a grayscale value obtained by adding the first offset value to the first representative value as the first logo level L1.

The second logo level determination unit or second logo level determiner 152B may calculate the second representative value for the reference area data among the first image data DATA1[N+1] of the N(+1)th frame, and determine a second logo level L2 for the N(+1)th frame in response to the second representative value.

For example, the second logo level determination unit or second logo level determiner 152B may set a grayscale value of a pixel PX corresponding to a predetermined higher level luminance (for example, the luminance corresponding to the upper 3% or the upper 30% in the reference area RFA or approximations thereof) among grayscale values of the pixels PX positioned in the reference area RFA based on the first image data DATA1[N+1] of the N(+1)th frame as the second representative value.

The second logo level determination unit or second logo level determiner 152B may determine the grayscale value corresponding to the second representative value (or a luminance level corresponding thereto) as the second logo level L2. In an embodiment, the second logo level determination unit or second logo level determiner 152B may determine the second representative value as the second logo level L2. In an embodiment, the second logo level determination unit or second logo level determiner 152B may determine a grayscale value obtained by applying a predetermined or selected second offset value to the second representative value as the second logo level L2. For example, the second logo level determination unit or second logo level determiner 152B may set a grayscale value obtained by adding the second offset value to the second representative value as the second logo level L2.

In an embodiment, the second offset value may be the same as the first offset value, but the disclosure is not limited thereto. For example, in an embodiment, the first logo level L1 and the second logo level L2 may be determined by applying different offset values to the first representative value and the second representative value.

The third logo level determination unit or third logo level determiner 152C may determine a final logo level (hereinafter, referred to as a third logo level L3) for the N(+1)th frame by comparing the first logo level L1 and the second logo level L2. The third logo level L3 may be a grayscale value (or a luminance level corresponding thereto) to be finally applied to the pixels PX to display the logo LG in the N(+1)th frame.

When the first logo level L1 is greater than the second logo level L2, the third logo level determination unit or third logo level determiner 152C may determine the first logo level L1 as the third logo level L3. In other cases, for example, when the second logo level L2 is greater than or equal to the first logo level L1, the third logo level determination unit or third logo level determiner 152C may determine the second logo level L2 as the third logo level L3. However, the disclosure is not limited thereto. For example, in an embodiment, the third logo level L3 may be determined by interpolating the first logo level L1 and the second logo level L2.

The data converter 153 may generate the second image data DATA2[N+1] of the N(+1)th frame in response to the logo level finally determined by the logo level determination unit or the logo level determiner 152, for example, the third logo level L3. For example, the data converter 153 may generate the second image data DATA2[N+1] of the N(+1)th frame by converting the grayscale value of the data corresponding to the logo LG among the first image data DATA1[N+1] of the N(+1)th frame. For example, the data converter 153 may generate the second image data DATA2[N+1] of the N(+1)th frame by converting (or replacing) grayscale values of the data corresponding to the logo LG among the first image data DATA1[N+1] of the N(+1)th frame to a grayscale value of the third logo level L3.

The second image data DATA2[N+1] of the N(+1)th frame may be supplied to the data driver 130 of FIG. 1 and used to generate the data signals. For example, the data driver 130 may generate the data signals corresponding to the second image data DATA2[N+1] of the N(+1)th frame, and supply the data signals to the pixels PX during the N(+1)th frame period.

According to the above-described embodiment, the luminance of the logo LG may be adaptively adjusted according to the luminance of the surrounding image. Accordingly, the visibility of the logo LG may be ensured, and deterioration of the pixels PX positioned or disposed in the logo area LG and afterimages caused by this may be prevented or reduced.

Further, according to the above-described embodiment, in determining the luminance of the logo LG in the current frame (for example, the N(+1)th frame), the luminance of the logo LG may be adjusted in real time by reflecting luminance of the current frame (for example, the N(+1)th frame) for a predetermined or selected reference area RFA located or disposed around the logo area LGA. Accordingly, the phenomenon in which the luminance of the surrounding image (for example, the image displayed on the peripheral area BGA including the reference area RFA) and the luminance of the logo LG are reversed may be prevented, and the visibility of the logo LG may be improved.

Figure 9:
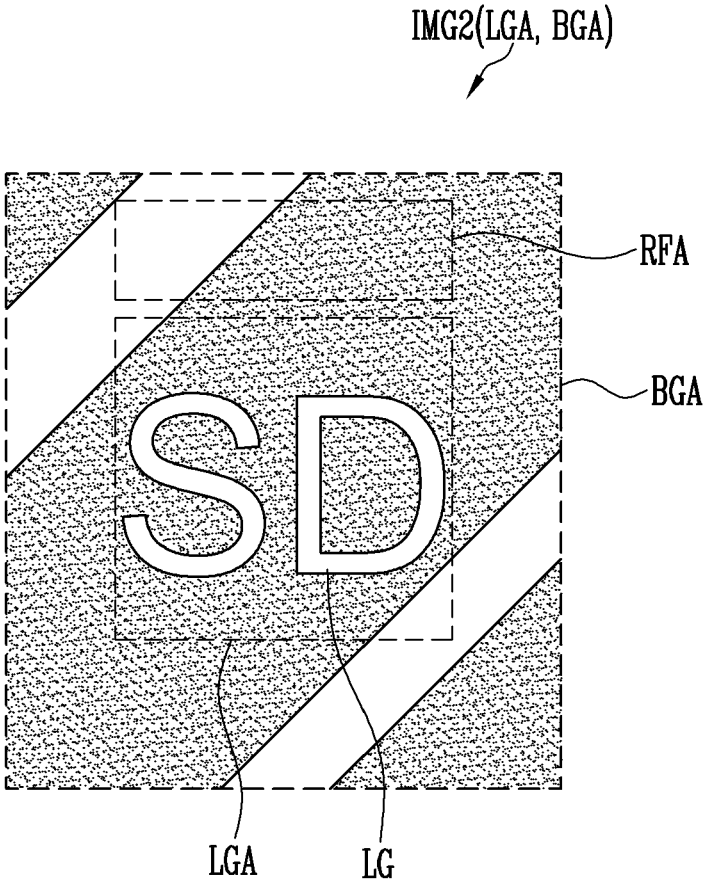
FIG. 9 is a diagram illustrating a logo area and a peripheral area of a second image according to an embodiment.
Figure 10:
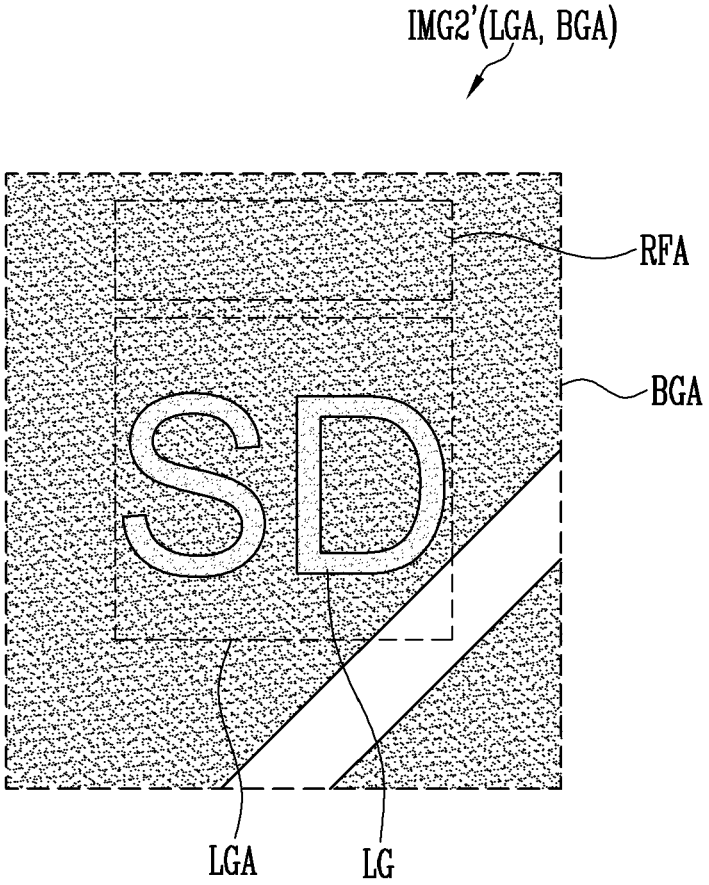
FIG. 10 is a diagram illustrating a logo area and a peripheral area of a second image according to an embodiment.

FIGS. 9 and 10 each show a logo area LGA and a peripheral area BGA of each of second images IMG2 and IMG2' according to an embodiment. According to an embodiment, the second images IMG2 and IMG2' may be images corresponding to the second image data DATA2 of each frame.

For example, in an embodiment in which the luminance of the logo LG displayed in the N(+1)th frame is adaptively adjusted by comprehensively reflecting the first image data DATA1[N] (for example, the peripheral area data) of the N-th frame and the first image data DATA1[N+1] (for example, the reference area data) of the N(+1)th frame according to embodiments of FIGS. 1 to 8, FIGS. 9 and 10 show the images displayed in the logo area LGA and the peripheral area BGA.

Referring to FIGS. 9 and 10, according to the luminance of the peripheral area BGA in the previous frame (for example, the N-th frame) and the luminance of the reference area RFA in the current frame (for example, the N(+1)th frame), the luminance of the logo LG in the current frame may be adjusted. For example, as shown in FIG. 9, when the luminance of the reference area RFA in the current frame is relatively high, the luminance of the logo LG in the current frame may also be higher than the higher level luminance of the reference area RFA. On the other hand, as shown in FIG. 10, when the luminance of the reference area RFA in the current frame is relatively low, the luminance of the logo LG in the current frame may also decrease.

A method of driving the display device 100 according to the embodiments described with reference to FIGS. 1 to 10 may include detecting a logo LG and a logo area LGA including the same using first image data DATA1[N] of at least an N-th frame; setting a peripheral area BGA according to the logo area LGA, and calculating a first representative value from data corresponding to the peripheral area BGA among the first image data DATA1[N] of the N-th frame; setting a reference area RFA according to the logo area LGA and a scan direction (or scan order), and calculating a second representative value from data corresponding to the reference area RFA among first image data DATA1[N+1] of an N(+1)th frame; determining a logo level of the N(+1)th frame using the first representative value and the second representative value; generating second image data DATA2[N+1] of the N(+1)th frame by converting the first image data DATA1[N+1] of the N(+1)th frame in response to the determined logo level; and generating data signals corresponding to the second image data DATA2[N+1] of the N(+1)th frame and supplying the data signals to pixels PX.

According to the above-described embodiments, by adjusting the luminance of the logo area LGA (for example, the logo LG) according to the luminance of the surrounding image, deterioration of the pixels PX positioned or disposed in the logo area LG and afterimages caused by this may be prevented or reduced. Accordingly, the image quality of the display device 100 may be improved.

By adjusting the luminance of the logo LG in real time according to the luminance of the surrounding image, the phenomenon in which the luminance of the surrounding image and the luminance of the logo LG are reversed may be prevented. Accordingly, the visibility of the logo LG may be improved.

The effects according to the embodiments are not limited by the contents and effects described above, and more various effects are included in the disclosure.

Although the disclosure has been described in detail in accordance with the above-described embodiments, it should be noted that the above-described embodiments are for illustrative purposes only and are not intended to limit the disclosure. Those skilled in the art will understand that various modifications are possible within the scope of the disclosure.

The scope of the disclosure is not limited by the detailed descriptions of the specification, and should be defined by the accompanying claims. Furthermore, all changes or modifications of the disclosure derived from the meanings and scope of the claims, and equivalents thereof should be construed as being included in the scope of the disclosure.

What is claimed is:

1. A display device comprising:

pixels disposed in a display area;

an image converter that generates second image data of an (N+1)th frame by using first image data of an N-th frame and first image data of the (N+1)th frame; and a data driver that supplies a data signal corresponding to the second image data of the (N+1)th frame to the pixels during an (N+1)th frame period, wherein the image converter detects a logo and a logo area including the logo by using the first image data of the N-th frame, the image converter calculates a first representative value of data corresponding to a peripheral area of the logo area among the first image data of the N-th frame and a second representative value of data corresponding to a reference area among the first image data of the (N+1)th frame, the peripheral area is set as an area surrounding the logo area, the image converter selectively converts data for the logo among the first image data of the (N+1)th frame according to the first representative value and the second representative value to generate the second image data of the (N+1)th frame, the reference area is set as at least one area of an area of the peripheral area of the logo area that is scanned before the logo area, and the first representative value is set as a grayscale value of a pixel corresponding to a luminance among grayscale values of the pixels disposed in the peripheral area of the logo area, and the second representative value is set as a grayscale value of a pixel corresponding to a luminance among grayscale values of the pixels disposed in the reference area.

2. The display device of claim 1, wherein the peripheral area of the logo area is set as the area surrounding the logo area on four sides of the logo area.

3. The display device of claim 1, further comprising:

a scan driver that sequentially supplies scan signals from pixels disposed in a first row of the display area to pixels disposed in a last row of the display area during each frame period, wherein the reference area is set as an area located on a top of the logo area.

4. The display device of claim 1, further comprising:

a scan driver that sequentially supplies scan signals from pixels disposed in a last row of the display area to pixels disposed in a first row of the display area during each frame period, wherein the reference area is set as an area located at a bottom of the logo area.

5. The display device of claim 1, wherein the image converter includes:

a logo detector that detects the logo and the logo area by using the first image data of the N-th frame;

a logo level determiner that calculates the first representative value and the second representative value based on the logo area, and compares the first representative value and the second representative value to determine a logo level for the (N+1)th frame; and a data converter that generates the second image data of the (N+1)th frame by converting a grayscale value of data corresponding to the logo among the first image data of the (N+1)th frame in response to the logo level.

6. The display device of claim 5, wherein the logo level determiner includes:

a first logo level determiner that calculates the first representative value for data corresponding to the peripheral area among the first image data of the N-th frame, and determines a first logo level for the (N+1)th frame in response to the first representative value;

a second logo level determiner that calculates the second representative value for data corresponding to the reference area among the first image data of the (N+1)-th frame, and determines a second logo level for the (N+1)th frame in response to the second representative value; and a third logo level determiner that compares the first logo level and the second logo level to determine a third logo level for the (N+1)th frame.

7. The display device of claim 6, wherein the third logo level determiner determines the first logo level as the third logo level when the first logo level is greater than the second logo level, and the third logo level determiner determines the second logo level as the third logo level when the second logo level is greater than or equal to the first logo level.

8. The display device of claim 6, wherein the data converter converts the grayscale value of the data corresponding to the logo among first image data of the (N+1)th frame in response to the third logo level.

9. The display device of claim 1, wherein the first representative value is set as a grayscale value of a pixel corresponding to a higher level luminance among grayscale values of the pixels disposed in the peripheral area of the logo area based on the first image data of the N-th frame, and the second representative value is set as a grayscale value of a pixel corresponding to a higher level luminance among grayscale values of the pixels disposed in the reference area based on the first image data of the (N+1)th frame.

10. A method of driving a display device comprising:

detecting a logo and a logo area including the logo by using first image data of an N-th frame;

setting a peripheral area according to the logo area, and calculating a first representative value from data corresponding to the peripheral area among the first image data of the N-th frame, wherein the peripheral area is set as an area surrounding the logo area;

setting a reference area according to the logo area, and calculating a second representative value from data corresponding to the reference area among first image data of an (N+1)th frame;

determining a logo level of the (N+1)th frame using the first representative value and the second representative value;

generating second image data of the (N+1)th frame by converting the first image data of the (N+1)th frame in response to the logo level; and generating a data signal corresponding to the second image data of the (N+1)th frame and supplying the data signal to pixels, wherein the reference area is set as at least one area of an area of the peripheral area of the logo area that is scanned before the logo area, and the first representative value is set as a grayscale value of a pixel corresponding to a luminance among grayscale values of the pixels disposed in the peripheral area of the logo area, and the second representative value is set as a grayscale value of a pixel corresponding to a luminance among grayscale values of the pixels disposed in the reference area.

11. The method of claim 10, wherein the peripheral area is set as the area surrounding the logo area on four sides of the logo area.

12. The method of claim 10, wherein the calculating of the first representative value includes setting a grayscale value of a pixel corresponding to a higher level luminance among grayscale values of pixels disposed in the peripheral area based on the first image data of the N-th frame as the first representative value.

13. The method of claim 10, wherein the calculating of the second representative value includes setting a grayscale value of a pixel corresponding to a higher level luminance among grayscale values of pixels disposed in the reference area based on the first image data of the (N+1)th frame as the second representative value.

14. The method of claim 10, wherein the determining of the logo level of the (N+1)th frame includes:

setting a grayscale value obtained by applying a first offset value to the first representative value as a first logo level;

setting a grayscale value obtained by applying a second offset value to the second representative value as a second logo level; and determining a third logo level by comparing the first logo level and the second logo level.

15. The method of claim 14, wherein the determining of the third logo level includes:

determining the first logo level as the third logo level when the first logo level is greater than the second logo level; and determining the second logo level as the third logo level when the second logo level is greater than or equal to the first logo level.

16. The method of claim 10, wherein the generating of the second image data of the (N+1)th frame includes converting a grayscale value of data corresponding to the logo among first image data of the (N+1)th frame to a grayscale value corresponding to the logo level in response to the logo level.

* * * * *